US005245908A

United States Patent [19]

Sanderson

[11] Patent Number: 5,245,908

[45] Date of Patent: Sep. 21, 1993

[54] PLANK-MOUNTED AIRCRAFT ARMAMENT SYSTEM HAVING IMPROVED AMMUNITION MAGAZINE APPARATUS AND ASSOCIATED MOUNTING STRUCTURE

[76] Inventor: Paul H. Sanderson, 2019 Cripple Creek, Lewisville, Tex. 75067

[21] Appl. No.: 980,644

[22] Filed: Nov. 24, 1992

Related U.S. Application Data

[60] Division of Ser. No. 874,032, Apr. 27, 1992, which is a continuation-in-part of Ser. No. 614,504, Nov. 16, 1990, Pat. No. 5,187,318, and a continuation-in-part of Ser. No. 532,172, Jun. 4, 1990, Pat. No. 5,024,138, which is a continuation of Ser. No. 297,970, Jan. 17, 1989, abandoned, which is a division of Ser. No. 144,873, Jan. 13, 1988, Pat. No. 4,893,545.

[51] Int. Cl.[5] ..... F41A 9/34

[52] U.S. Cl. ..... 89/34; 89/33.16; 89/33.04

[58] Field of Search ..... 89/34, 33.14, 33.16, 89/33.04, 33.01, 33.1

[56] References Cited

U.S. PATENT DOCUMENTS

| | | | |
|---|---|---|---|
| 2,382,715 | 8/1945 | Hertel | 89/33.16 |
| 2,459,934 | 1/1949 | Haberlin | 89/34 |
| 2,870,681 | 1/1959 | Linke | 89/34 |
| 3,670,623 | 6/1972 | Kuyper | 89/34 |
| 4,433,609 | 2/1984 | Darnall | 89/34 |
| 4,951,548 | 8/1990 | Wixon et al. | 89/33.14 |
| 4,972,758 | 11/1990 | Austin et al. | 89/33.16 |

FOREIGN PATENT DOCUMENTS

| | | | |
|---|---|---|---|
| 531695 | 1/1941 | United Kingdom | 89/34 |
| 582509 | 11/1946 | United Kingdom | 89/33.14 |

*Primary Examiner*—Stephen M. Johnson
*Attorney, Agent, or Firm*—Konneker, Bush & Hitt

[57] ABSTRACT

A helicopter armament system includes an elongated support plank longitudinally extending transversely through the helicopter and having opposite end portions projecting outwardly beyond opposite sides of the helicopter. Mounted on these opposite plank end portions are a pair of 0.50 caliber machine guns supplied with belted ammunition by two ganged pairs of ammunition magazine boxes supported within the cabin area, on the top side of the plank, by roller support structures operable to isolate the boxes from forces arising from plank flexure, and to significantly facilitate operative attachment of the boxes to the plank and subsequent removal of the boxes therefrom. Using specially designed inserts and lid structures, each of the boxes may be rapidly converted between 0.50 caliber and 7.62 mm ammunition belt storage and outfeed, and the same boxes may be used individually or ganged in a two or four box group to feed a 0.50 caliber machine gun, or used individually or ganged in a two box group to feed a 7.62 mm machine gun.

4 Claims, 9 Drawing Sheets

PLANK-MOUNTED AIRCRAFT ARMAMENT SYSTEM HAVING IMPROVED AMMUNITION MAGAZINE APPARATUS AND ASSOCIATED MOUNTING STRUCTURE

CROSS-REFERENCE TO RELATED APPLICATIONS

This application is a division of copending U.S. application Ser. No. 874,032 filed on Apr. 27, 1992, which was a continuation-in-part of copending U.S. application Ser. No. 614,504 now U.S. Pat. No. 5,187,318 which was filed on Nov. 16, 1990 and was a continuation-in-part of U.S. application Ser. No. 532,172 filed on Jun. 4, 1990 now U.S. Pat. No. 5,024,138. Application Ser. No. 532,172 was a continuation of U.S. application Ser. No. 297,970 (now abandoned), filed on Jan. 17, 1989, which was a division of U.S. application Ser. No. 144,873 filed on Jan. 13, 1988 and issued on Jan. 16, 1990 as U.S. Pat. No. 4,893,545 which is hereby incorporated by reference herein.

BACKGROUND OF THE INVENTION

The present invention relates generally to armament apparatus for aircraft, and, in a preferred embodiment thereof, more particularly relates to ammunition magazine apparatus for storing ammunition belts fed to aircraft-mounted machine guns, and to structure used to mount the magazine apparatus on the aircraft.

Disclosed in U.S. Pat. No. 4,893,545 (incorporated by reference herein) is an aircraft armament system representatively utilized in conjunction with a helicopter and including an elongated support plank, of a reinforced honeycomb metal construction, which longitudinally extends transversely through the cabin area of the helicopter, with opposite end portions of the plank projecting outwardly beyond opposite sides of the helicopter. longitudinally central portion of the plank within the cabin is secured to the helicopter, and the outwardly projecting plank ends each carry a 0.50 caliber machine gun pod, or a 7.62 mm machine gun, and a multi-tube rocket launcher.

Belted ammunition for the two plank-supported machine guns is carried within two elongated rectangular magazine boxes secured to the top side of the plank within the cabin area. The ammunition belt from each magazine box is routed outwardly through a cabin door and downwardly through a plank slot to the box's associated machine gun.

While this plank-based aircraft weaponry mounting system has proven to be a substantial improvement over conventional aircraft weaponry mounting systems, it has been found that certain problems, limitations and disadvantages are associated with both the conventional ammunition magazine box structures and the conventional method used to secure them to the support plank.

For example, each of the elongated, high capacity magazine boxes shown in U.S. Pat. No. 4,893,545 (when fully loaded with ammunition) is quite heavy, and typically requires more than two men to lift it into the cabin area and properly orient it on the support plank. This task is even more difficult in low light conditions.

Once in place, the two large magazine boxes are secured to the top side of the plank using conventional aircraft tie-down straps. This magazine attachment method has proven to be less than completely satisfactory from two primary standpoints. First, current military design criteria require, among other things, that the supported magazine box structures be able to withstand at least a 4G crash load. Conventional tie-down straps typically cannot meet this requirement. Additionally, despite its desirably high level of structural rigidity, the central support plank portion is subject to at least some degree of lateral (i.e., up and down) flexure during flight of the aircraft. When conventional tie-down straps are used to hold the magazine boxes directly against the plank, the flexure of the plank unavoidably transfers undesirable vertical bending forces to the magazine boxes. Magazine boxes must often be installed and removed at night under combat conditions. Tie-down straps would be difficult at best to install properly under these low light/stressful conditions.

Another problem relating to the use of conventional ammunition magazine box structures in this application arises from the high degree of weaponry mounting diversity provided by the plank-based system. For example, various combinations and arrangements of both 0.50 caliber and 7.62 mm machine guns (with or without rocket launchers) may be mounted on the outer plank ends. More specifically, depending upon the particular mission of the aircraft, the plank may be used to carry one 0.50 caliber machine gun, one 7.62 mm machine gun, two 0.50 caliber machine guns, two 7.62 mm machine guns, or one 0.50 caliber machine gun and one 7.62 mm machine gun.

This weaponry mounting diversity has heretofore required that, in transporting the helicopter and its associated armament system to a mission site, two pairs of the illustrated elongated ammunition magazine boxes (two each in 0.50 caliber and 7.62 mm sizes) be provided to accommodate whatever aircraft machine gun arrangement the particular mission might require. As can be envisioned, this requires an overall magazine box storage volume and weight approximately twice that of the weight and volume of the two magazine boxes illustrated in U.S. Pat. No. 4,893,545. Moreover, in certain instances a particular mission may not require that a full magazine box load of ammunition be carried on the aircraft for a given machine gun. This reduced ammunition requirement may, of course, be accommodated simply by only partially filling one of the large capacity boxes shown in such patent. However, when this is done, the empty portion of the box undesirably takes up cabin space which could be used for other purposes, and adds, in effect, dead weight to the overall aircraft load.

In view of the foregoing, it is an object of the present invention to provide an improved ammunition magazine box system, and associated mounting structure therefor, which eliminates or minimizes the above-mentioned and other problems, limitations and disadvantages heretofore associated with conventional magazine boxes of the general type described above.

SUMMARY OF THE INVENTION

In carrying out principles of the present invention, in accordance with a preferred embodiment thereof, an improved machine gun ammunition magazine box system and related mounting structure are provided which are particularly well suited for use in supplying belted ammunition to a machine gun forming a part of the support plank-based aircraft armament system shown in U.S. Pat. No. 4,893,545.

According to one aspect of the invention, a magazine box mounting structure is secured to the top side of the support plank, within the aircraft cabin area, and is uniquely operative to facilitate the proper orientation on and operative attachment to the plank of an ammunition magazine box, used to supply belted ammunition to machine gun, and additionally functions to isolate the attached magazine box from undesirably vertical bending forces arising from plank flexure during flight of the aircraft. The magazine box mounting structure also enables the attached box to withstand high G forces without becoming separated from the plank.

The magazine box mounting structure, in a preferred embodiment thereof, comprises a longitudinally spaced pair of bracket structures securable to the top side of the plank, and an elongated support rail structure having rollers mounted on its top side. Attachment means are provided for securely attaching the support rail structure to the bracket structures, in a vertically spaced relationship with the plank, and are operative to pivotally connect a first end of the support rail structure to the first bracket structure, and to connect a second end of the support rail structure to the second bracket structure in a manner permitting a predetermined, limited amount of relative longitudinal movement between the second bracket structure and rail end during vertical bending flexure of the plank portion to which the magazine box mounting structure is secured.

In mounting the magazine box on the plank, the box is positioned on and rolled along the top side of the support rail structure, until the box is longitudinally aligned therewith, and then fixedly anchored thereto. Lateral alignment between the box and the underlying support rail structure is facilitated by first and second depending flanges on the box that nestingly engage corresponding upstanding flanges on the support rail structure, and by a depending central rib on the box which is received in central annular grooves formed on the support rail rollers. Importantly, due to the "lost" longitudinal connection between the second bracket structure and support rail end the attached magazine box is essentially isolated from vertical bending forces caused by plank flexure.

According to another aspect of the invention, in a preferred embodiment thereof, a set of four ammunition magazine boxes is provided, each box having associated therewith one of four plank-secured magazine box mounting structures as described above. Each box has an open upper end and is configured to operatively receive, support and store, in a longitudinally serpentined orientation, at least a longitudinal portion of a 0.50 caliber machine gun ammunition belt.

Conversion insert means are provided and are selectively and removably insertable within each of the magazine boxes to reconfigure its interior to operatively receive, support and store at least a longitudinal portion of a 7.62 mm machine gun ammunition belt.

Additionally, conversion lid means are provided which are selectively and removably securable to one, two or all four of the magazine boxes. Such conversion lid means are operative to selectively facilitate 0.50 caliber or 7.62 mm ammunition belt outfeed from each magazine box. The conversion lid means are usable in conjunction with the conversion insert means to permit a selected one of the magazine boxes to be used to feed 7.62 mm ammunition to a 7.62 mm machine gun mounted on the support plank. The conversion insert is not required when using 0.50 caliber ammunition to feed a 0.50 caliber machine gun mounted on the support plank.

The conversion lid means are also usable to permit a selected two of the magazine boxes to be ganged and collectively used to feed 0.50 caliber ammunition to a 0.50 caliber machine gun mounted on the support plank, or, in conjunction with the conversion insert means and the other conversion lid, to be ganged and collectively used to feed 7.62 mm ammunition to a 7.62 mm machine gun mounted on the plank (i.e., two boxes to one gun, or four boxes to two guns). Additionally, the proper conversion lid means may be used to permit all four of the magazine boxes to be ganged and collectively used to feed 0.50 caliber ammunition to a 0.50 caliber machine gun mounted on the plank (i.e., four boxes to one 0.50 caliber gun).

This modular, convertible ammunition magazine box approach to supplying ammunition to two different caliber machine guns substantially reduces the magazine storage weight and volume required since one box can be used to outfeed ammunition belts of two different calibers without the previous need for supplying two separate boxes to perform this function. Additionally, this modular approach permits easier handling and maneuvering of the magazine structures since, due to the ability to gang a plurality of boxes, each box may be of a smaller, more manageable size.

For example, in the representative four box set of the present invention, each magazine box is sized to hold either approximately 500 rounds of 0.50 caliber ammunition or approximately 2800 rounds of 7.62 mm ammunition and weighs only approximately 175 to 200 pounds when fully loaded. This permits two men to relatively easily carry and maneuver one of the boxes, and lift it into the aircraft cabin area for securement to one of the previously described magazine box mounting structures.

DETAILED DESCRIPTION

Figure 1:
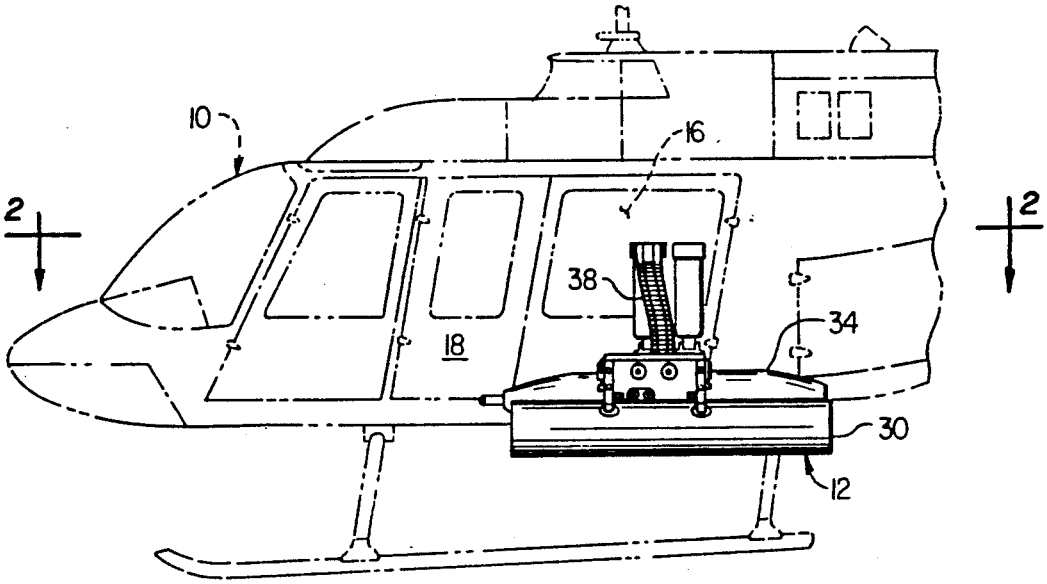
FIG. 1 is a phantomed side elevational view of a front portion of a representative helicopter to which a plank-mounted armament system, embodying principles of the present invention, is operatively secured.
Figure 2:
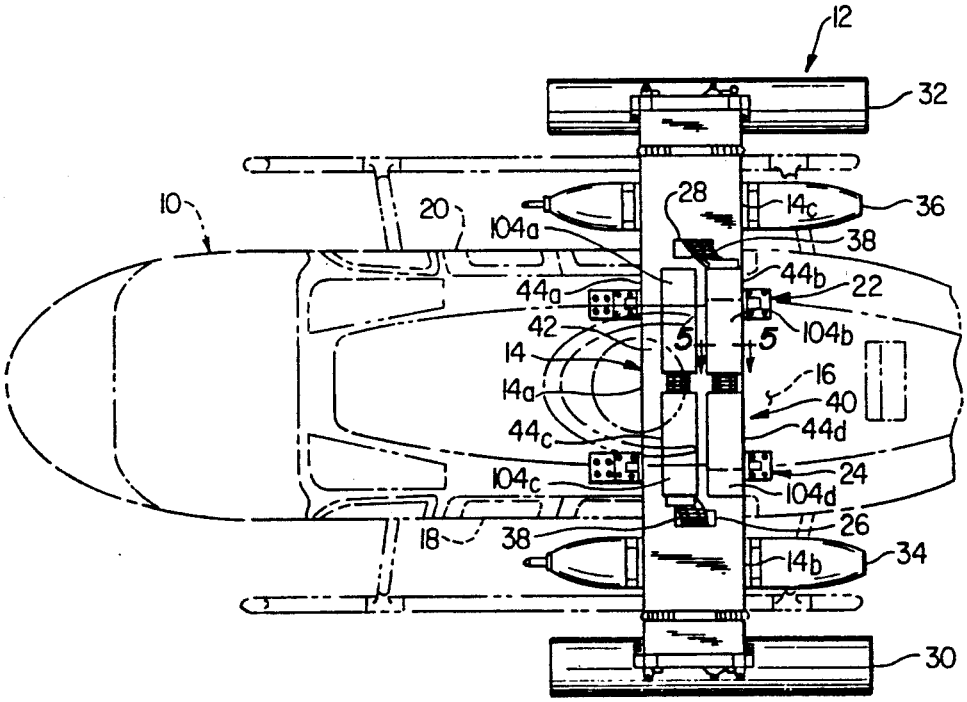
FIG. 2 is a cross-sectional view through the helicopter taken along line 2—2 of FIG. 1.

Illustrated in phantom in FIGS. 1 and 2 is a representative aircraft, in the form of a helicopter 10, to which an armament system 12 is operatively secured. With the important differences noted below, the armament system 12 is similar to the aircraft armament system illustrated and described in U.S. Pat. No. 4,893,545 which has been incorporated by reference herein. Basically, the armament system 12 includes an elongated support plank member 14 which longitudinally extends transversely through a cabin area 16 of the helicopter, with a central longitudinal portion $14_a$ of the plank disposed within the cabin area, and outer ends $14_b$, $14_c$ of the plank projecting outwardly beyond opposite sides 18 and 20 of the helicopter. The central plank portion $14_a$ is anchored within the cabin area 16 by mounting structures 22 and 24, and slots 26 and 28 respectively extend downwardly through the outer plank ends $14_b$ and $14_c$.

Secured to and positioned beneath the opposite ends of the plank 14 are a pair of multiple tube rocket launchers 30 and 32 which are positioned outwardly of a pair of 0.50 caliber machine gun pods 34 and 36 which are also secured to and positioned beneath the opposite plank ends. Further structural and operational details regarding the portions of the armament system 12 described thus far may be found in the referenced U.S. Pat. No. 4,893,545.

In accordance with principles of the present invention, the machine guns 34 and 36 are respectively supplied with ammunition by two 0.50 caliber ammunition belts 38 which are routed (via ammunition feed chutes which have been removed for illustrative purposes) downwardly through the plank slots 26 and 28 from a specially designed ammunition magazine system 40 mounted on the top side 42 of the central plank portion $14_a$ within the cabin area 16 in a unique manner subsequently described herein. As will be seen, the ammunition magazine system 40 is uniquely convertible between the illustrated 0.50 caliber ammunition use, and 7.62 mm ammunition use, so that the illustrated 0.50 caliber machine guns 34, 36 may be replaced with 7.62 mm machine guns (not shown) if desired.

Figure 3:
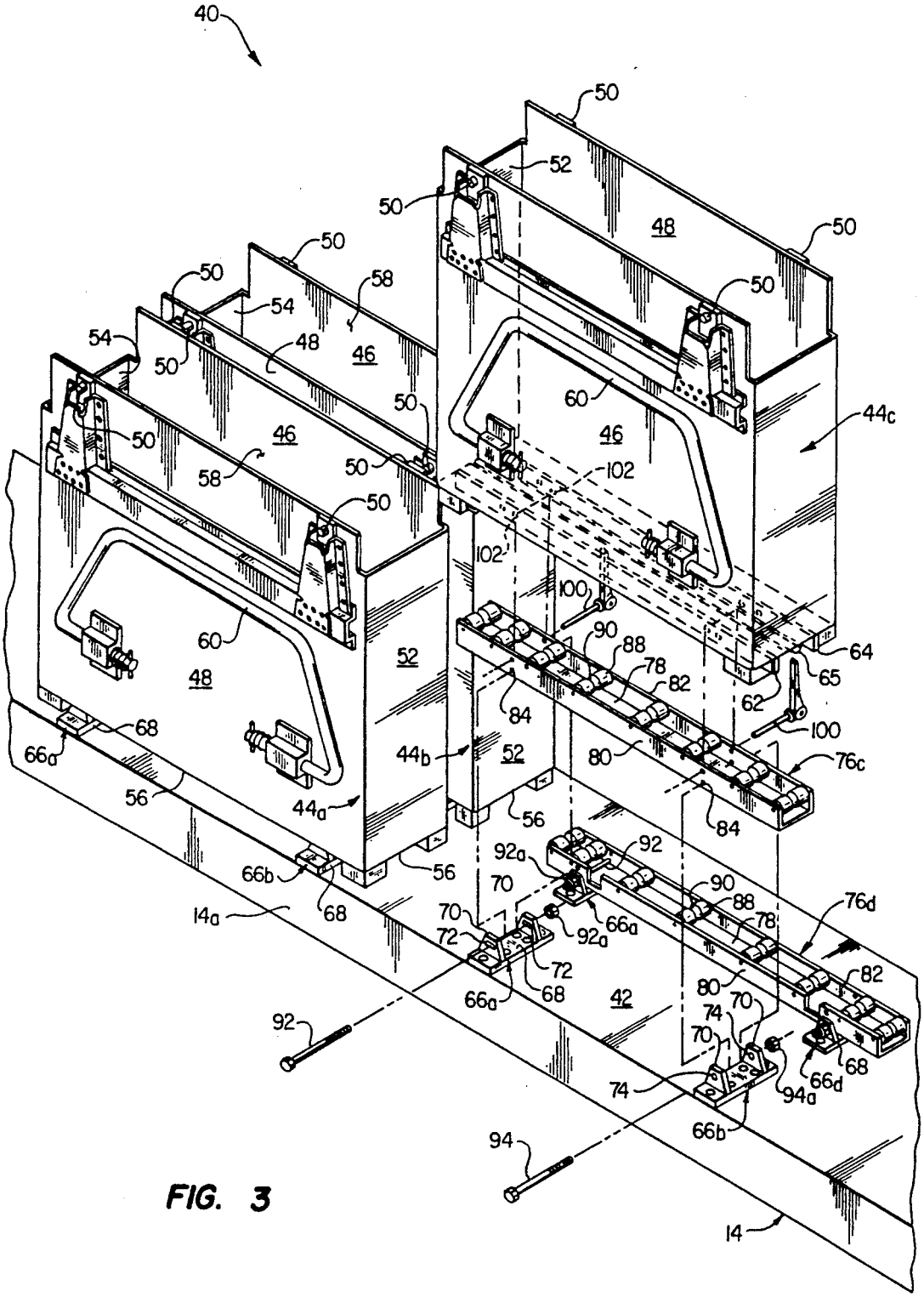
FIG. 3 is an enlarged scale, partially exploded perspective view of a longitudinally central portion of the plank-supported armament system, with one of the four ammunition magazine boxes shown in FIG. 2 deleted, and the lid portions of the remaining three boxes removed, for purposes of illustrative clarity.
Figure 4:
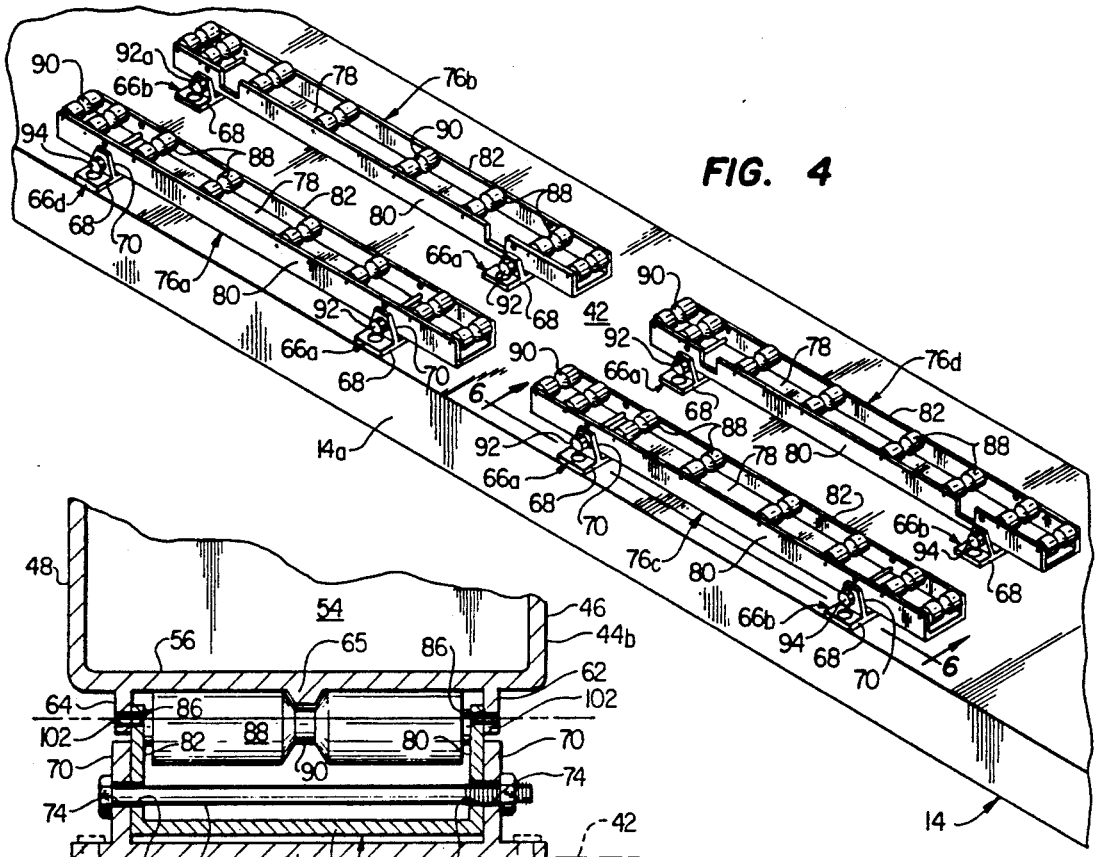
FIG. 4 is an enlarged scale perspective view of a longitudinally central portion of the support plank, and the four associated magazine box mounting structures secured thereto, with all four of the magazine boxes removed.

Referring now to FIGS. 2–6, the ammunition magazine system 40 includes elongated rectangular metal magazine boxes 44 (only three of which are illustrated in FIG. 3), each having a pair of opposite vertical side walls 46 and 48 with outwardly projecting lugs 50 at their upper ends, a pair of opposite vertical end walls 52 and 54, a bottom wall 56, a open top end 58, and a pair of spring-loaded carrying handles 60 secured to the opposite side walls 46,48 of each of the boxes 44. Extending longitudinally along the bottom wall 56 of each of the boxes 44, and depending therefrom, are a spaced pair of flanges 62, 64 and a central rib 65 disposed therebetween.

The four boxes 44 are anchored to the top side 42 of the longitudinally central plank portion $14_a$ by a unique mounting which will now be described with reference to FIGS. 3–6. The mounting system includes four longitudinally spaced pairs $66_a$, $66_b$ of mounting bracket members 66 positioned atop the upper plank side 42 in the relative orientation best illustrated in FIG. 4. Each of the mounting bracket members 66 includes a base portion 68 which is suitably anchored to and through the upper plank side 42, and a pair of spaced apart, upstanding flanges 70. For purposes later described, the flanges 70 of the bracket members 66, have aligned, horizontally elongated slots 72 formed therethrough, while the flanges 70 of each of the bracket members $66_b$ have aligned circular openings 74 formed therethrough.

Figure 5:
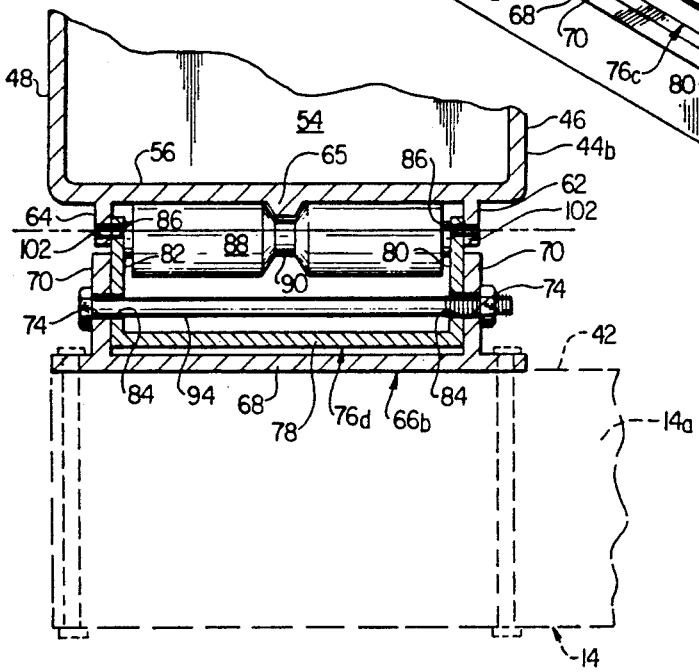
FIG. 5 is an enlarged scale, partially phantomed crossed sectional view through a lower portion of one Of the magazine boxes, and its underlying support structure, taken along line 5—5 of FIG. 2.

The specially designed ammunition box mounting system of the present invention also includes four elongated support rail structures $76_a$–$76_d$ each having, along its length, a base wall 78, a spaced pair of flanges 80 and 82 projecting upwardly from the opposite side edges of the base wall 78, laterally aligned pairs of lower openings 84 formed through the flanges 80, 82 adjacent the opposite ends of each support rail 76, and aligned upper pairs of openings 86 formed through the flanges 80, 82 adjacent the opposite ends of each of the support rails 76. A longitudinally spaced series of rollers 88 are journaled between each of the support rail flange pairs 80 and 82. As best illustrated in FIG. 5, each of the rollers 88 laterally projects upwardly beyond the upper side edges of its associated flange pair 80 and 82 and has a central annular notch 90 formed therein.

Each of the support rail structures 76 is supported by an associated mounting bracket member 66 by positioning the support rail structure 76 between the upstanding flanges 70 in a slightly elevated position relative to the top side of the mounting bracket member base portion 68. A first bolt 92 is then passed through the horizontally elongated flange slots 72 and the lower flange openings 84 at one end of the support rail 76, and secured with a nut $92_a$. Additionally, a bolt 94 is passed through the upstanding flange openings 74 and the support rail flange openings 84 at the opposite end of the support rail 76 and secured with a nut $94_a$.

Figure 6:
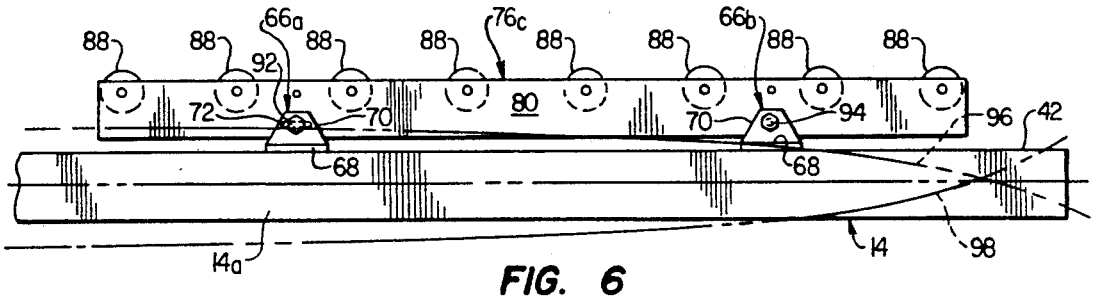
FIG. 6 is an enlarged scale side elevational view of one of the plank-mounted magazine box support structures, taken along line 6—6 of FIG. 4, and illustrates the unique capability of the support structure to permit plank flexure without transferring corresponding flexural forces to the magazine box which it supports.

Referring now to FIG. 6, during flight of the helicopter 10, the longitudinally central support plank portion 14, is subject to upward bending flexure as indicated by the line 96 in FIG. 6, and downward bending flexure as illustrated by the line 98 in FIG. 6. Each of the support rail structures 76, however, is isolated from vertical bending forces due to the manner in which the support rail structure is connected to its associated mounting bracket members $66_a$, $66_b$ as described above. Specifically, as the central plank portion 14, flexes upwardly, the bolt 92 (FIG. 6) is simply moved leftwardly in the flange slot 72 to prevent the support rail $76_c$ from being upwardly bent. Conversely, when the central plank within the horizontally elongated flange slot 72 to prevent the support rail 76 from being downwardly bent.

Each of the magazine boxes 44 is secured atop its associated support rail structure by simply placing the bottom box rib 65 (FIG. 5) within the roller notches 90, with the bottom box flanges 62, 64 positioned outwardly of the support rail flanges 80 and 82, and then rolling the box 44 along the top of the underlying support rail until the box is longitudinally aligned with the support rail structure. The box 44 is then securely anchored to its associated support rail structure by a pair of conventional expansion pin members 100 (FIG. 3) which are passed through box flange openings 102 aligned with the upper support rail flange openings 86 at the opposite ends of the support rail. This firmly anchors the magazine boxes 44 to the support plank in a manner permitting the secured boxes to withstand the requisite high G loads without becoming detached from the support plank. Additionally, because the support rail structures 76 are isolated from vertical bending forces created by plank flexure, the attached magazine boxes 44 are also isolated from such vertical bending forces.

Figure 7:
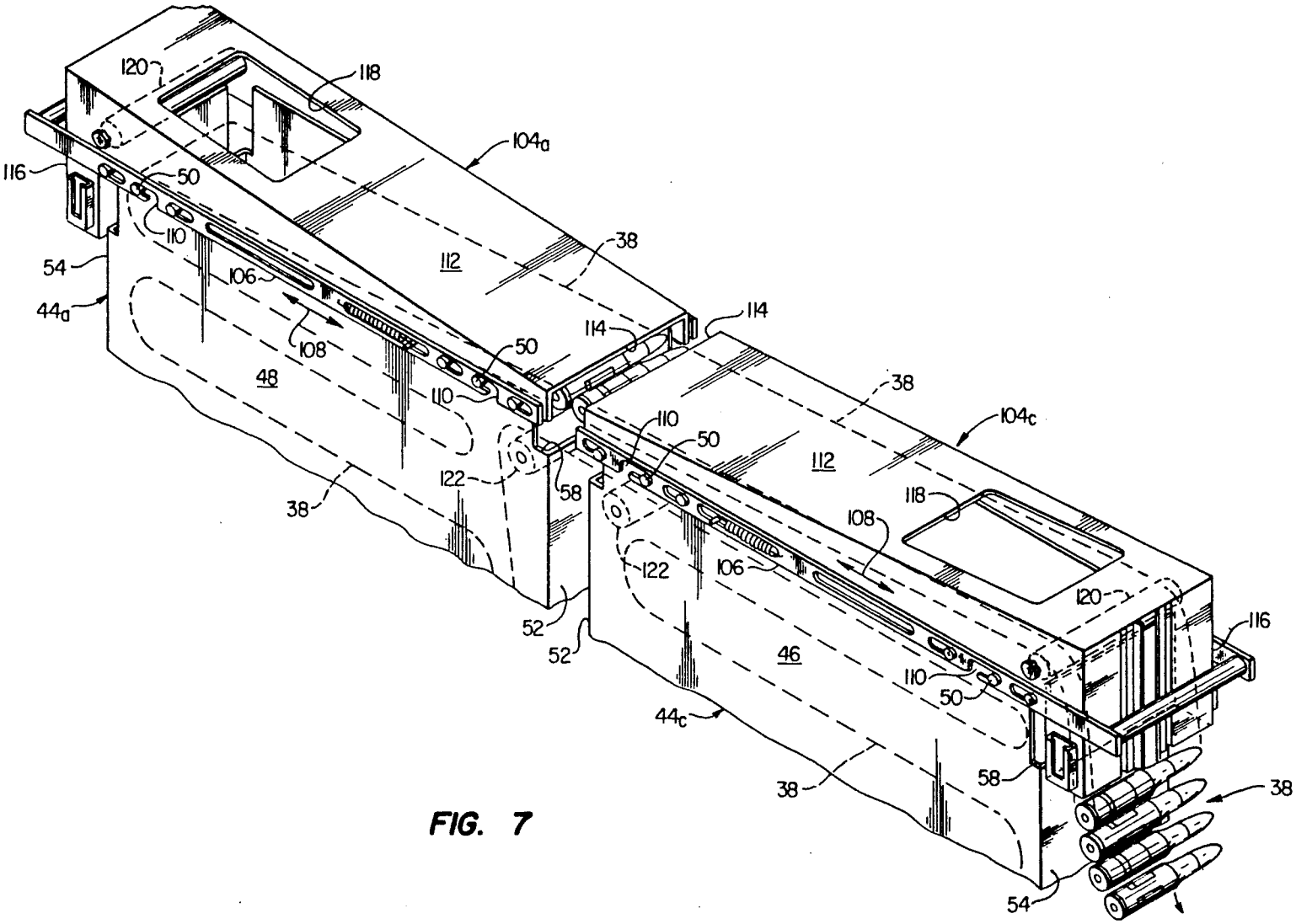
FIG. 7 is an enlarged scale perspective view of upper end portions of two of the ammunition magazine boxes shown in FIG. 2, and illustrates the two boxes being ganged and collectively used to feed a 0.50 caliber ammunition belt stored therein to a 0.50 caliber machine gun mounted on an outer end portion of the support plank.
Figure 11A:
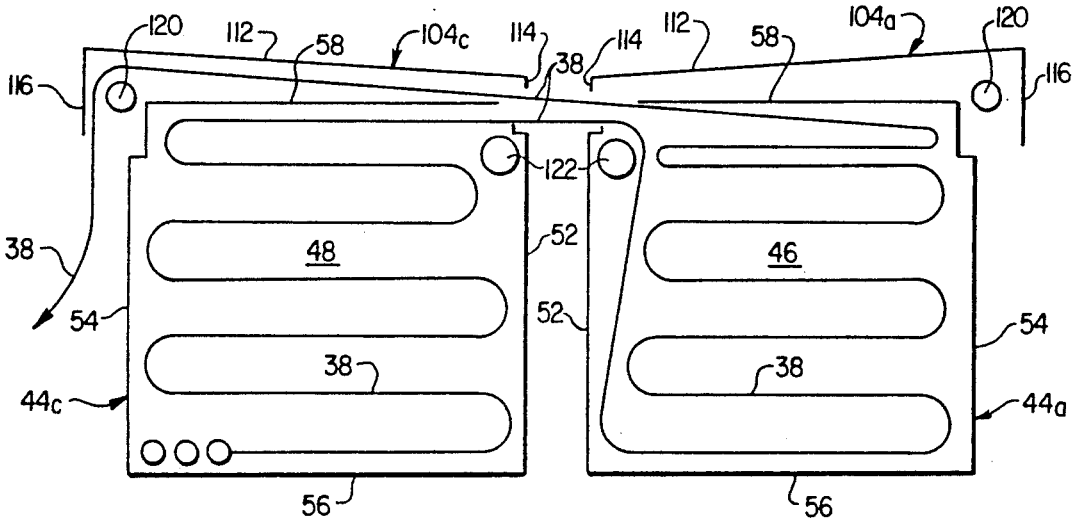
FIG. 11A is a schematic cross-sectional view through two of the magazine boxes and illustrates the 0.50 caliber ammunition belt routing therein when the boxes are ganged end-to-end to collectively feed ammunition to a single 0.50 caliber machine gun.

Referring now to FIGS. 7 and 11A, the two magazine boxes $44_a$ and $44_c$ shown in FIGS. 2 and 3 are ganged end-to-end to outfeed the 0.50 caliber ammunition belt 38 to the 0.50 caliber machine gun 34. To effect this end-to-end ganging of the boxes $44_a$ and $44_c$, these two magazine boxes are provided with removable lid structures $104_a$ and $104_c$. Each of the lids $104_a$ and $104_c$ is removably attached to the open upper end 58 of its associated magazine box by a spring-loaded, generally U-shaped latch bar member 106 carried by the lid for horizontal movement relative thereto as indicated by the double-ended arrows 108. Formed in the bottom side edges of the parallel arms of each of the latch structures 106 are a pair of generally L-shaped slots 110 which receive and releasably hold the previously described lugs 50 on the boxes $46_a$, $46_c$.

Each of the lids $104_a$, $104_c$ has an elongated rectangular top panel 112, an open end 114, an open, downturned opposite end 116, and an access opening 118 formed through the top panel 112 adjacent the downturned lid end 116. Outlet feed rollers 120 are journaled within the downturned lid ends 116, and guide rollers 122 are journaled within the boxes $44_a$, $44_c$ in top corner portions thereof adjacent the open lid ends 114.

As schematically illustrated in FIG. 11A, the 0.50 caliber ammunition belt 38, starting at its inner end, is longitudinally serpentined within the box $44_c$, is passed through the open lid ends 114 and over the guide rollers 122, is longitudinally serpentined within the box $44_a$, and is then passed back through the open lid ends 114, over the outlet feed roller 120 of lid $104_c$ and exits the downturned lid end portion 116 of lid 104, for supply to the machine gun 34 (FIG. 2).

Figure 11B:
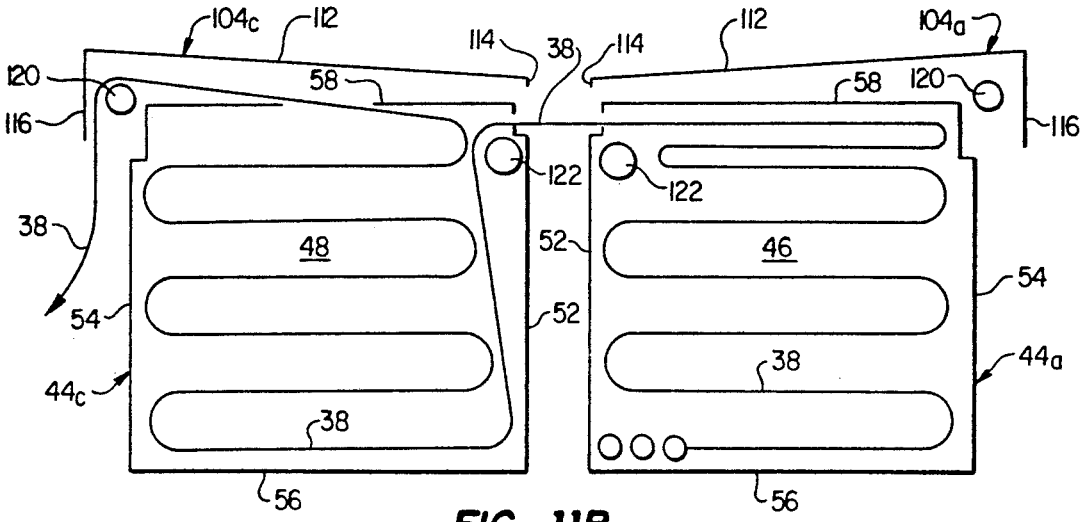
FIG. 11B is a view similar to that in FIG. 11A and illustrates an alternate ammunition belt routing within the two depicted magazine boxes.

An alternate loading of the 0.50 caliber ammunition belt within the end-to-end boxes $44_a$, $44_c$ is illustrated in FIG. 11B. From its inner end, the ammunition belt 38 is longitudinally serpentined within the box $44_a$, passes through the open lid ends 114 and over the guide rollers 122, is longitudinally serpentined within the box $44_c$, and then passes upwardly over the feed roller 120 of the box $104_c$ and out its downturned lid end 116 for feed to the machine gun 34.

In a similar fashion, the boxes $44_b$ and $44_d$ illustrated in FIG. 2 are ganged end-to-end, using lids $44_b$ and $44_d$, to collectively feed a 0.50 caliber ammunition belt 38 to the 0.50 caliber machine gun 36.

Figure 10:
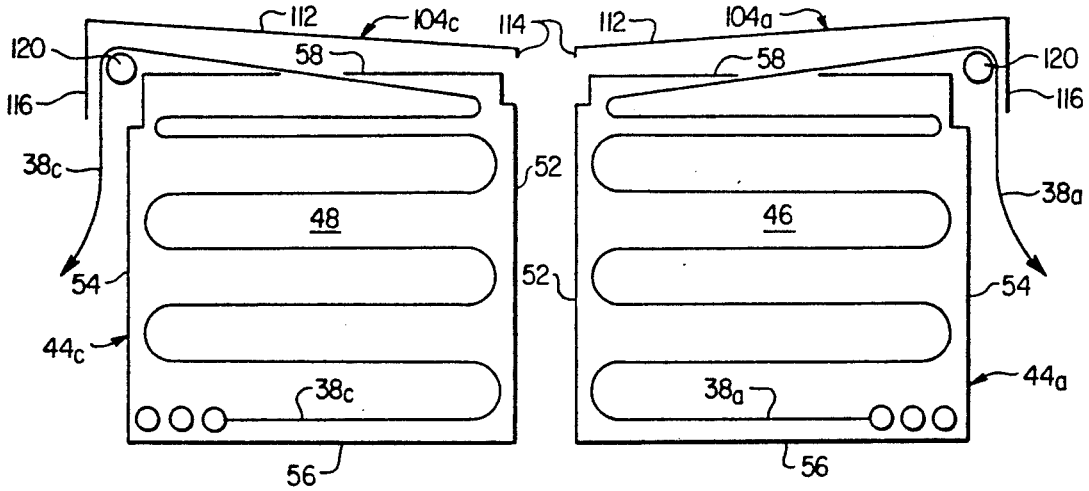
FIG. 10 is a schematic cross-sectional view through two of the magazine boxes and illustrates the 0.50 caliber ammunition belt routing therein when each of the boxes is used to feed ammunition to a separate 0.50 machine gun.

These same lids 104 may be utilized in conjunction with the magazine boxes 44 to permit each box to be used singly to feed a 0.50 caliber ammunition belt to a 0.50 caliber machine gun. For example, the previously described magazine boxes $44_a$ and $44_c$, with the lids $104_a$ and $104_c$ respectively secured thereto, are illustrated in FIG. 10 in an operating mode in which each of the two boxes outfeeds a difference 0.50 caliber ammunition belt to a separate 0.50 caliber machine gun. Specifically, with the guide rollers 122 removed from the boxes $44_a$ and $44_c$, a 0.50 caliber ammunition belt $38_a$ is longitudinally serpentined within the box $44_a$, and passed outwardly over its feed roller 120, and a 0.50 caliber machine gun belt 38c is longitudinally serpentined within the box $44_c$ and passed outwardly therefrom over its feed roller 120.

The previous described lids 104 define a portion of an interchangeable lid system which, in conjunction with box insert means subsequentially described herein, permit the same four ammunition magazine boxes $44_a$–$44_d$ to be used individually, or ganged in various manners, to supply either 0.50 caliber ammunition to one or more 0.50 caliber machine guns, or to be used individually or ganged in various manners to supply 7.62 mm ammunition to one or more 7.62 mm machine guns.

Figure 9:
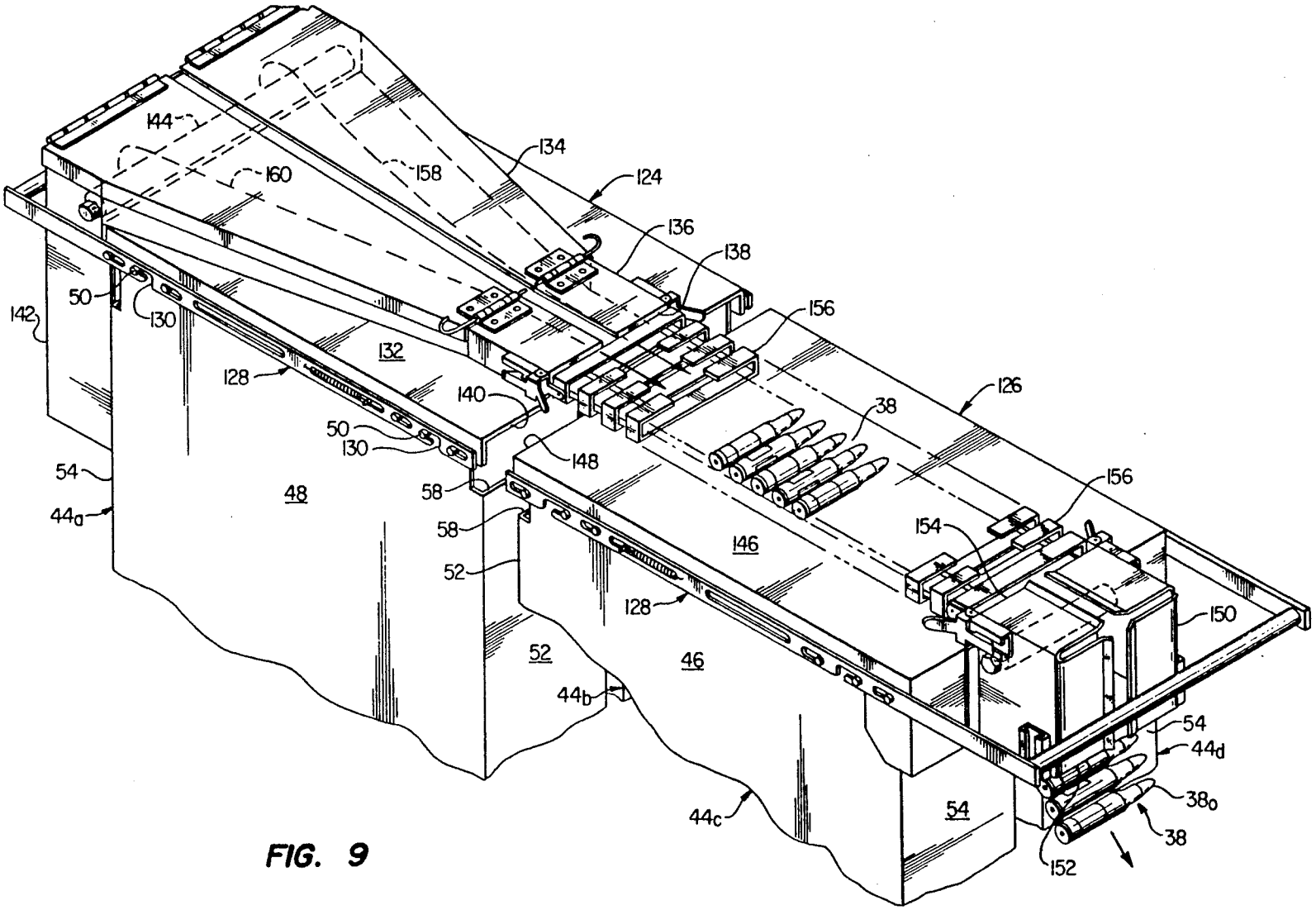
FIG. 9 is a perspective view of upper end portions of all four of the magazine boxes shown in FIG. 2 and illustrates the manner in which all four boxes may be ganged to collectively store and feed a 0.50 caliber ammunition belt to a single 0.50 caliber machine gun.

Referring now to FIG. 9, this interchangeable lid system also includes lid structures 124 and 126 which may be utilized to gang all four of the ammunition magazine boxes $44_a$–$44_d$ (in the orientation of such four boxes shown in FIGS. 2 and 3) to permit the four boxes to collectively feed a 0.50 caliber ammunition belt 38 (FIG. 9) to a single 0.50 machine gun such as the plank-mounted machine gun 34 shown in FIGS. 1 and 2.

The lid structure 124 is removably securable to the boxes $44_a$ and $44_b$, over their open upper ends 58, by means of a spring-loaded latch bar structure 128 which is similar to the latch bar structures 106 previously described in conjunction with FIG. 7. The opposite parallel arms of the latch bar structure 128 have formed therein generally L-shaped slots 130 which receive and releasably hold the side wall lugs 50 on the walls 48 and 46 of the boxes $44_a$ and $44_b$. Lid 124 has a top panel 132 from which a horizontally tapered portion 134 upwardly projects. A narrowed end section 136 of the lid portion 134 has an open end 138 positioned upwardly adjacent the open end 140 of the lid 124. The opposite, widened end of the lid portion 134 is turned downwardly along the rear end walls 54 of the boxes $44_a$ and $44_b$, to define a cross-over housing portion 142 of the lid. A guide roller 144 is rotatably supported within an upper end portion of the cross-over housing 142.

The lid 126 is removably seourable over the open top ends of the boxes $44_c$ and $44_d$ by means of a spring-loaded latch structure 128 identical in configuration and operation to the latch structure 128 carried by the lid 124. Lid 126 has a top panel 146, and an open end 148 which faces and is spaced horizontally apart from the open end 140 of the lid 124. Externally secured to the right end of the lid 126, and extending downwardly along the end walls 54 of the boxes $44_c$ and $44_d$, is a hollow outlet housing 150 having an open lower end 152, and a top end opening 154 which is positioned above the top end panel 146 and faces the open end 138 of the narrowed end section 136 of the lid 124. Secured to and extending between the openings 138 and 154 is a conventional flex chute 156 through which a 0.50 caliber ammunition belt may longitudinally pass.

From its outlet end $38_o$, the 0.50 caliber ammunition belt 38 shown in FIG. 9 sequentially passes upwardly through the outlet housing 150, leftwardly through the flex chute 156 and the tapered lid portion 134 and passes downwardly over the roller 144. From this point, the belt 38 extends rightwardly through the facing lid openings 140, 148, is longitudinally serpentined within the box $44_d$, is passed leftwardly through the facing lid openings 148, i40 and is longitudinally serpentined within the box $44_b$. The belt is then passed into the cross-over housing 142, is laterally twisted within the housing 142, and is then sequentially serpentined within the box $44_a$, passed rightwardly through the facing lid openings 140 and 148, and is longitudinally serpentined at its inner end within the box $44_c$. Accordingly, during operation of the 0.50 caliber machine gun with which the four magazine boxes $44_a$–$44_d$ are collectively associated, the ammunition belt 38 is sequentially fed to the gun, via the flex chute 156, from boxes $44_d$ and $44_b$, as indicated by the dotted arrow 158, and then successively fed through the chute 156 from the boxes $44_a$ and $44_c$ as indicated by the arrow 160.

Figure 14:
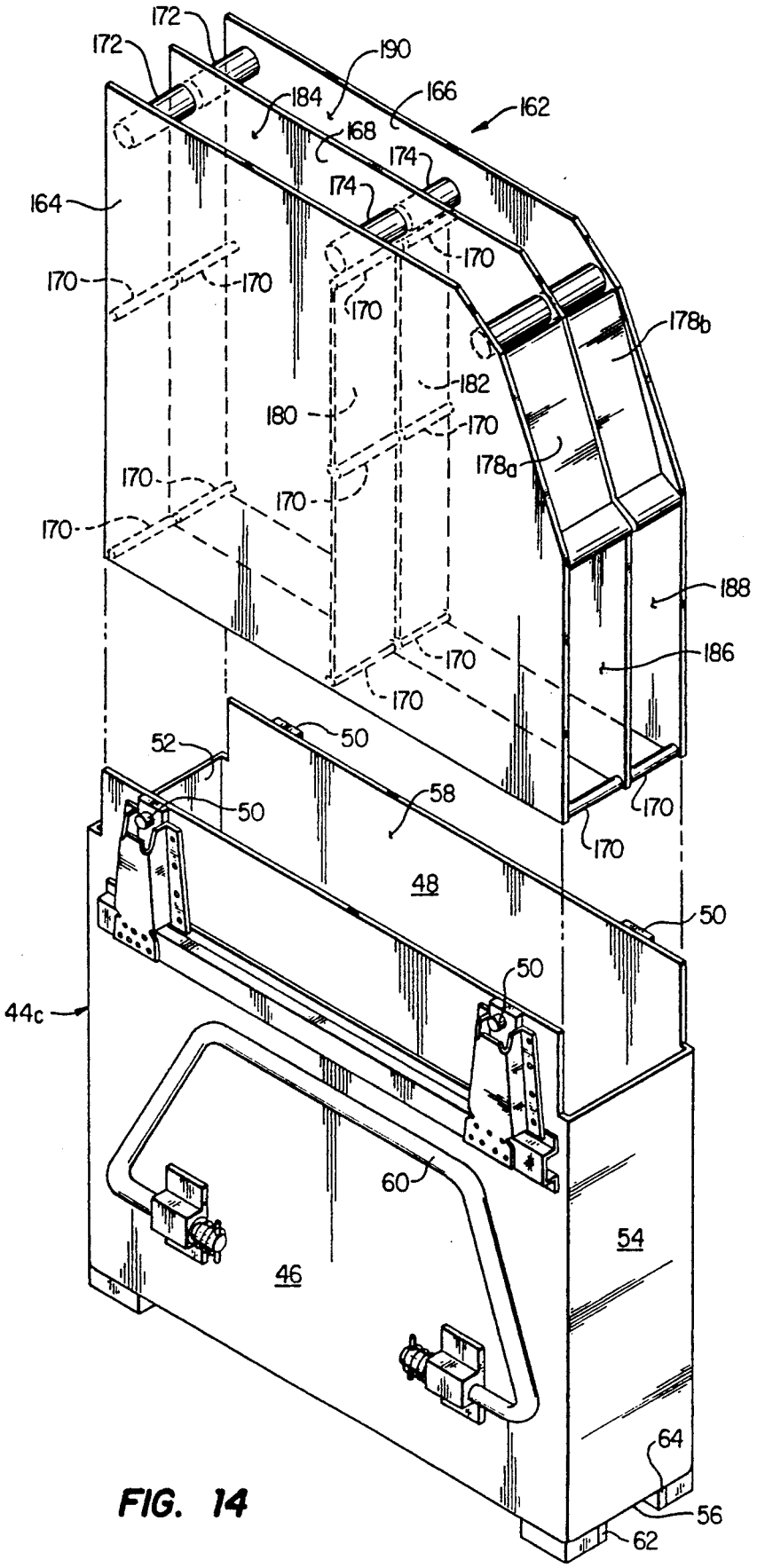
FIG. 14 is an enlarged scale exploded side perspective view of one of the magazine boxes, with its lid removed, and illustrates an insert structure used to convert the box from 0.50 caliber ammunition use to 7.62 mm ammunition use.

Referring now to FIG. 14, each of the four magazine boxes 44 is provided with a conversion insert structure 162 which may be downwardly inserted into the box 44 to reconfigure its interior from a 0.50 caliber ammunition use configuration to a 7.62 mm ammunition use configuration. As illustrated in FIG. 14, each of the conversion insert structures 162 includes a pair of spaced apart, parallel outer side walls 164 and 166, between which a parallel central dividing wall 168 is interposed. The walls 164, 166, and 168 are intersecured by suitable transverse connection pin members 170. Journaled between upper edge portions of the walls 164, 166, and 168 are left end rollers 172, central rollers 174, and right end rollers 176. An inset, two-piece sloping end panel structure $178_a$, $178_b$ extends downwardly along an upper right corner portion of the structure 162, and a pair of transverse interior divider panels 180, 182 extend downwardly from adjacent the rollers 174.

The various walls and panels of the conversion insert structure 162 divide its interior into a chamber 184 positioned to the left of the panel 180 between the walls 164 and 168; a chamber 186 positioned between the walls 164 and 168 to the right of the panel 180; a chamber 188 positioned between the walls 166 and 168 to the right of panel 182; and a chamber 190 positioned between the walls 166 and 168 to the left of panel 182. Additionally, the panel 178 defines with top right corner portions of the walls 164 and 166 a cross-over chamber 192. With the conversion structure 162 inserted downwardly into the magazine box 44, these chambers are disposed within the box and partially bounded by its walls.

Figure 8:
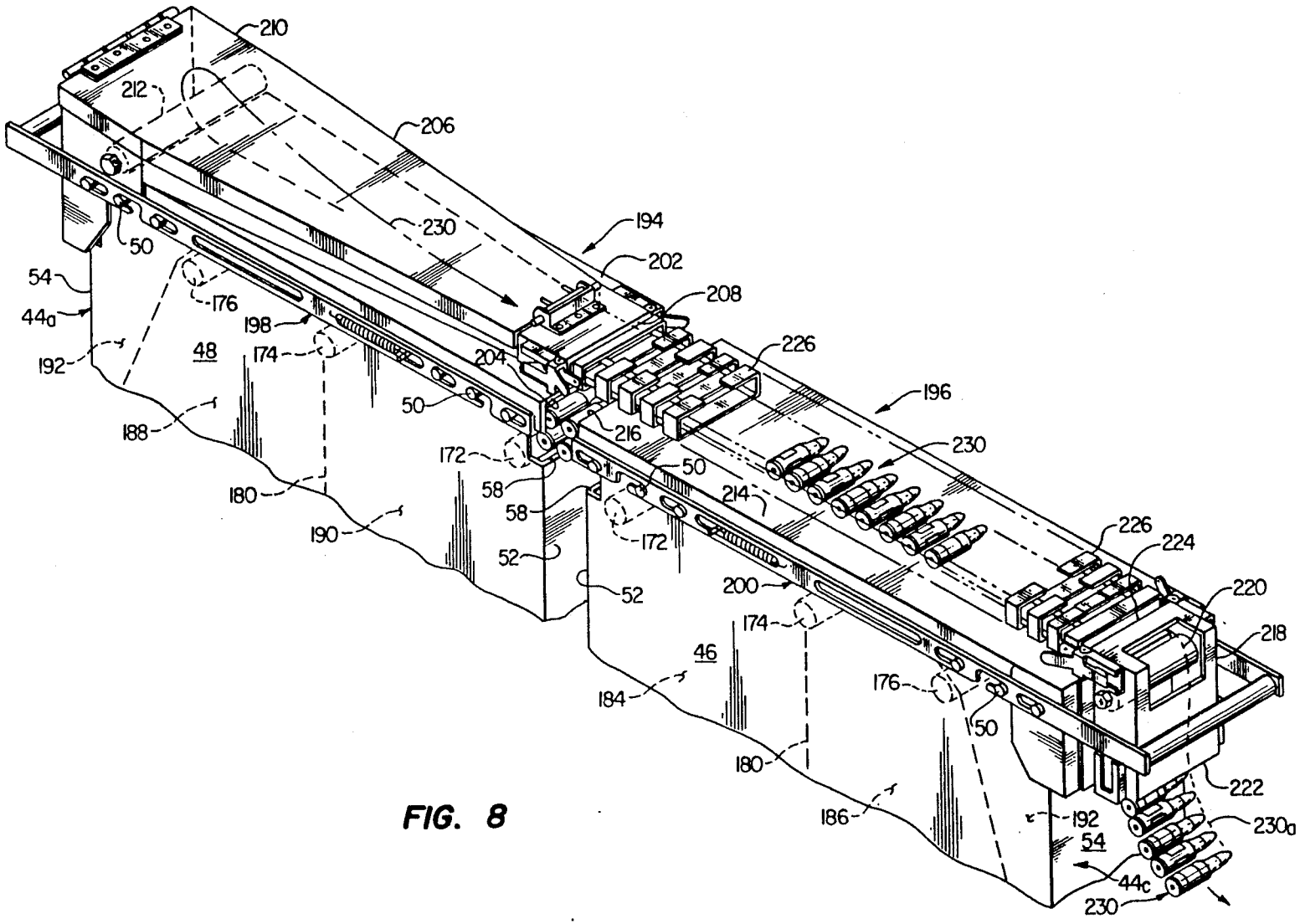
FIG. 8 is a perspective view of upper end portions of the two magazine boxes of FIG. 7 and illustrates the unique manner in which the boxes may be converted and ganged to collectively store and feed a 7.62 ammunition belt to a 7.62 mm machine gun.

Illustrated in FIG. 8 are the two previously described ammunition magazine boxes $44_a$ and $44_c$ which have been converted for 7.62 mm ammunition usage by the downward insertion into their interiors of two of the conversion structures 162. Forming a part of the previously mentioned interchangeable lid set, and further facilitating the use of the boxes $44_a$, $44_c$ in a 7.62 mm ammunition application, are lid structures 194 and 196 respectively and removably secured to the open upper ends 58 of the boxes $44_a$, $44_c$ by latch structures 198, 200 of the same type and configuration as those carried by the previously described lid structures.

The lid structure 194 has a top panel 202, an open right end 204, and a horizontally tapered portion 206 which projects upwardly from the top panel 202. Lid portion 206 has a narrowed open end 208 positioned adjacent the open right end 204 of the lid 194, and a widened left end 210 within which a guide roller 212 is journaled and positioned above the cross-over chamber 192 defined within the box $44_a$ by the conversion structure 162 operatively disposed therein.

The right lid structure 196 has a top panel 214, an open left end 216, and an outlet housing 218 secured to the right end of the lid and having an outlet guide roller 220 transversely journaled therein. The outlet housing 218 has an open lower end 222, and a top end opening 224 which faces the narrowed open end 208 of the lid portion 206 and is connected thereto by a conventional flex chute 226 sized for a 7.62 mm ammunition belt.

Figure 13A:
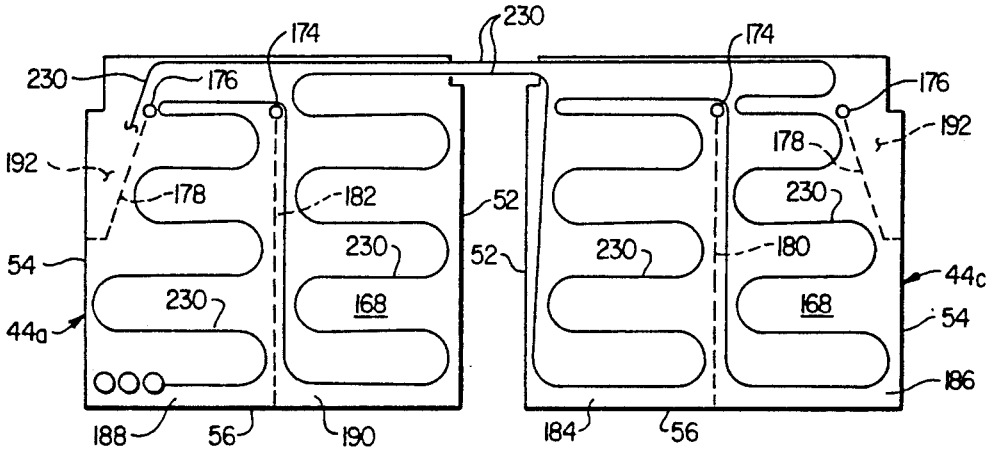
FIGS. 13A and 13B, respectively, are schematic cross-sectional views through front and rear side portions of two of the magazine boxes, which have been converted for use with 7.62 mm ammunition and ganged end-to-end to collectively feed a single 7.62 mm machine gun, and illustrates the ammunition belt routing within the boxes.
Figure 13B:
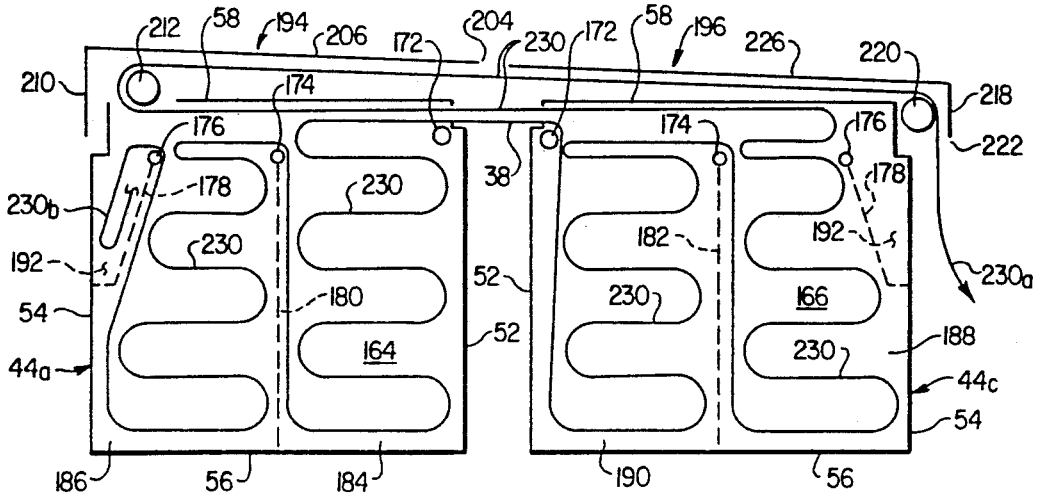

With reference now to FIGS. 8, 13A and 13B, a 7.62 mm machine gun ammunition belt 230 is operatively received and supported within the ganged ammunition boxes $44_a$, $44_c$ (which have been internally converted for 7.62 mm ammunition usage), and outfed from the ganged boxes to a 7.62 mm machine gun (not shown) in the following manner. From its outer end portion $230_a$, the ammunition belt 230, as indicated in FIG. 13B, is passed upwardly through the outlet housing 218, passed over the roller 220, extended leftwardly through the lids 196 and 194, passed downwardly over the roller 212, and passed back to the chamber 188. The belt 230 is then longitudinally serpentined within the chamber 188, passed upwardly over the roller 174 therein, longitudinally serpentined within the chamber 190, passed upwardly over the rollers 172, longitudinally serpentined within the chamber 184 of box $44_a$ passed upwardly over the roller 174 therein, longitudinally serpentined within the chamber 186 of box $44_a$, and carried upwardly over the roller 176 into the cross-over chamber in box 44, in which the belt is laterally twisted as at $230_b$.

Referring now to FIG. 13A, the belt 230 is then routed from the cross-over chamber 192 of box 44, through the lids 194 and 196 to the chamber 186 of box $44_c$ in which it is longitudinally serpentined. Belt 230 is then passed upwardly over the roller 174 of box $44_c$, longitudinally serpentined within the chamber 184, and then passed into the chamber 190 of box 44, and serpentined therein. Finally, the belt 230 is carried upwardly over the roller 174 of box 44, and is longitudinally serpentined within chamber 188 as illustrated in FIG. 13A.

Accordingly, when the ammunition belt 230 is outfed from the ganged boxes $44_a$ and $44_c$, it is successively removed from the chambers 188, 190 of box $44_a$ the chambers 184, 186 of box $44_a$; chambers 186, 184 of box $44_c$; and chambers 190, 188 of box $44_a$.

Figure 12A:
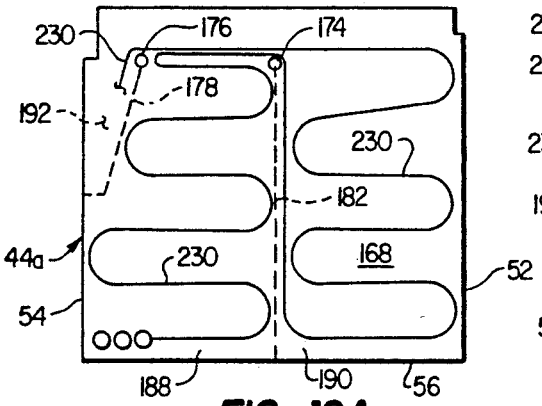
FIGS. 12A and 12B, respectively, are schematic cross-sectional views through front and rear side portions of one of the magazine boxes which has been converted for use with 7.62 mm ammunition, and illustrates the ammunition belt routing therein when the box is used to feed ammunition to a 7.62 mm machine gun.
Figure 12B:
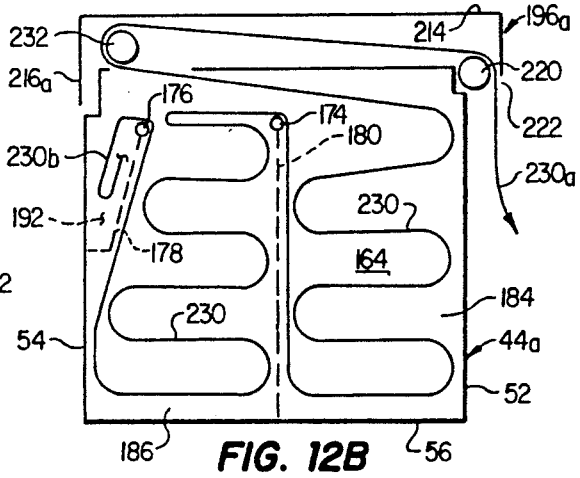

Referring now to FIGS. 12A and 12B, any of the magazine boxes 44, such as the box 44, shown in FIGS. 12A and 12B, may be individually converted for use with 7.62 mm ammunition simply by downwardly inserting into the box one of the previously described conversion structures 162 and releasably latching a lid 196, (part of the interchangeable lid set) to the open upper end of the box. Lid 196, is similar in configuration to the previously described lid 196 except that its left end $216_a$ (FIG. 12B) is closed and has a guide roller 232 transversely journaled therein.

From its outer end $230_a$, the 7.62 mm machine gun ammunition belt 230 illustrated in FIGS. 12A and 12B is extended upwardly over the outlet guide roller 220 (FIG. 12B), passed over the guide roller 232 and returned to the chamber 184, longitudinally serpentined within chamber 184, passed over the roller 174 and longitudinally serpentined within the chamber 186, and then passed over the roller 176 into the cross-over chamber 192. Belt 230 is then laterally twisted within chamber 192, as at $230_b$, and, as illustrated in FIG. 12A carried across the rollers 176, 174 to the chamber 190. The belt is then longitudinally serpentined within chamber 190, carried over the roller 174, and longitudinally serpentined within the chamber 188. Accordingly, when the ammunition belt 230 is outfed from the box $44_a$ shown in FIGS. 12A and 12B, the belt is successively pulled from the chambers 184, 186, 190 and 188.

As can be seen from the foregoing, the previously described interchangeable lid set, in conjunction with the conversion insert structures 162, permit the same four magazine boxes $44_a$–$44_d$ to be used in a variety of ammunition feeding applications. For example, each magazine box may be individually used to supply ammunition to either a 0.50 caliber or 7.62 mm machine gun. Alternatively, the magazine boxes may be ganged in sets of two so that each ganged box pair may be used to collectively feed ammunition to either a 0.50 caliber or 7.62 mm machine gun. Further, as previously described, all four magazine boxes may be ganged to collectively feed 0.50 caliber ammunition to a 0.50 caliber machine gun. Importantly, this unique convertability of the magazine boxes 44 eliminates the necessity of providing differently configued boxes to handle an ammunition caliber changeover.

This modular, convertible ammunition magazine concept significantly facilitates the ability to mount and supply ammunition to various combinations of 0.50 caliber and 7.62 mm machine guns mounted on the illustrated support plank ends $14_a$–$14_d$ and to better accommodate the weaponry diversity of the aircraft armament system 12.

The modular magazine system just described also facilitates the manual handling and transport of the boxes 44. In this regard it should be noted that each of the magazine boxes $44_a$–$44_d$ is approximately half the size of the two-plank-mounted magazine boxes illustrated in the referenced U.S. Pat. No. 4,893,545. Each of the magazine boxes 44 preferably has a maximum ammunition capacity of approximately 500 rounds of 0.50 caliber ammunition or 2800 rounds of 7.62 mm ammunition and, when filled with either caliber ammunition, weighs approximately 200 pounds. Accordingly, any of the magazine boxes 44, together with its full load of ammunition may be relatively easily carried and maneuvered by two men. This is a significant advantage when the boxes must be lifted onto and off of the plank section within the helicopter cabin area 16.

Moreover, the previously described ammunition box mounting structure with which the magazine boxes 44 are secured to the longitudinally central support plank section significantly facilitates the placement of the ammunition magazine boxes within the helicopter cabin atop the support plank. Due to the roller guided placement of the ammunition boxes upon their associated support rail structures, each box may be easily and rapidly secured to the support plank even in low light conditions.

The foregoing detailed description is to be clearly understood as being given by way of illustration and example only, the spirit and scope of the present invention being limited solely by the appended claims.

What is claimed is:

1. Ammunition magazine apparatus for use in selectively supplying ammunition to either a 0.50 caliber machine gun or a 7.62 mm machine gun, said ammunition magazine apparatus comprising:

a plurality of magazine box structures having open upper ends and being operatively positionable in a mutually adjacent relationship, said plurality of magazine box structures being configured to operatively receive, support and store serpentined, interconnected longitudinal sections of a first ammunition belt carrying 0.50 caliber ammunition;

first lid means removably securable to said open upper ends of the operatively positioned plurality of magazine box structures and operative to facilitate a sequential outfeed of the stored longitudinal sections of the first ammunition belt to the 0.50 caliber machine gun;

conversion means removably insertable into said plurality of magazine box structures for reconfiguring their interiors to operatively receive, support and store serpentined, interconnected longitudinal sections of a second ammunition belt carrying 7.62 mm ammunition;

second lid means removably securable to said open upper ends of the operatively positioned plurality of magazine box structures, in place of said first lid means, and being operative to facilitate a sequential outfeed of the stored longitudinal sections of the second ammunition belt to the 7.62 mm machine gun, whereby the same plurality of magazine box structures may be ganged and used in conjunction with either of the 0.50 caliber and 7.62 mm machine guns, the 0.50 caliber ammunition holding capacity of each of said plurality of magazine box structures being approximately 500 rounds, and the 7.62 mm ammunition holding capacity of each of said plurality of magazine box structures being approximately 2800 rounds.

2. The ammunition magazine apparatus of claim 1 wherein:

the fully loaded weight of each of said plurality of magazine box structures is not substantially more than about 200 pounds, whereby each said fully loaded magazine box structure may be relatively easily carried and maneuvered by two men.

3. Ammunition magazine apparatus for use in selectively supplying ammunition to either a 0.50 caliber machine gun or a 7.62 mm machine gun, said ammunition magazine apparatus comprising:

a set of four magazine box structures having open upper ends, each of said magazine box structures being configured to operatively receive, support and store, in a longitudinally serpentined orientation, at least a longitudinal portion of a first machine gun ammunition belt carrying 0.50 caliber ammunition, said set of four magazine box structures being selectively positionable in:

a first magazine arrangement defined by a single one of said magazine box structures, a second magazine arrangement defined by two of said magazine box structures in an adjacent relationship, and a third magazine arrangement defined by all four of said magazine box structures in an adjacent relationship;

conversion insert means selectively and removably positionable within each of said magazine box structures for reconfiguring its interior to operatively receive, support and store at least a longitudinal portion of a second machine gun ammunition belt carrying 7.62 mm ammunition;

first lid means, removably securable to the single magazine box structure in said first magazine arrangement to facilitate first ammunition belt outfeed therefrom;

second lid means, removably securable to the single magazine box structure in said first magazine arrangement to facilitate second ammunition belt outfeed therefrom;

third lid means, removably securable to the two magazine box structures in said second magazine arrangement to gang the two magazine box structures and facilitate first ammunition belt outfeed therefrom;

fourth lid means, removably securable to the two magazine box structures in said second magazine arrangement to gang the two magazine box structures and facilitate second ammunition belt outfeed therefrom; and fifth lid means, removably securable to the four magazine box structures in said third magazine arrangement to gang the four magazine box structures and facilitate first ammunition belt outfeed therefrom, each of said four magazine box structures having a 0.50 caliber ammunition holding capacity of approximately 500 rounds and a 7.62 mm ammunition holding capacity of approximately 2800 rounds.

4. The ammunition magazine apparatus of claim 3 wherein:

each of said four magazine box structures, when fully loaded with ammunition, has a weight not substantially more than about 200 pounds, whereby each said fully loaded magazine box structure may be relatively easily carried and maneuvered by two men.

* * * * *